US006848624B2

(12) United States Patent
Dianetti et al.

(10) Patent No.: US 6,848,624 B2
(45) Date of Patent: Feb. 1, 2005

(54) REFRIGERATION EXPANSION VALVE WITH THERMAL MASS POWER ELEMENT

(75) Inventors: Eugene A. Dianetti, Rochester Hills, MI (US); Roy J. Nungesser, Oviedo, FL (US); Daniel R. Rice, Macedon, NY (US); Gary A. Nearpass, Clyde, NY (US); Cary Haramoto, Newark, NY (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 10/688,578

(22) Filed: Oct. 17, 2003

(65) Prior Publication Data

US 2004/0129008 A1 Jul. 8, 2004

Related U.S. Application Data

(60) Provisional application No. 60/419,876, filed on Oct. 18, 2002.

(51) Int. Cl.[7] ..... F25B 41/04
(52) U.S. Cl. ..... 236/92 B; 62/225
(58) Field of Search ..... 62/255; 236/92 B

(56) References Cited

U.S. PATENT DOCUMENTS

| | | | |
|---|---|---|---|
| 1,512,243 | A | 10/1924 | Shrode |
| 1,987,948 | A | 1/1935 | Smith |
| 2,221,062 | A | 11/1940 | Starr |
| 2,306,768 | A | 12/1942 | Wile |
| 2,598,187 | A | 5/1952 | Meyer |
| 2,631,612 | A | 3/1953 | Buescher |
| 2,786,336 | A | 3/1957 | Lange |
| 3,450,345 | A | 6/1969 | Orth et al. |
| 3,537,645 | A | 11/1970 | Treder |
| 3,667,247 | A | 6/1972 | Proctor |
| 3,691,783 | A | 9/1972 | Proctor |

FOREIGN PATENT DOCUMENTS

| | | |
|---|---|---|
| EP | 0 659 600 | 6/1995 |
| EP | 0 691 517 | 1/1996 |
| EP | 0 537 776A1 B1 | 3/1997 |
| EP | 0 836 061 | 4/1998 |
| EP | 0 846 927 | 10/1998 |
| FR | 1050101 | 1/1994 |
| FR | 831073 | 5/1998 |
| GB | 696 | 2/1898 |
| JP | 5-322381 | 7/1993 |
| JP | 08-193769 | 7/1996 |
| JP | 08-210734 | 8/1996 |
| JP | 9-159324 | 6/1997 |
| JP | 09-273835 | 10/1997 |

OTHER PUBLICATIONS

Copy of Notification of Transmittal of the International Search Report or the Declaration in corresponding International Application PCT/US03/33101.
Journal of Nippondenso Technical Disclosure, published 1986.

(List continued on next page.)

*Primary Examiner*—William E. Tapolcai
(74) *Attorney, Agent, or Firm*—John A. Molnar, Jr.

(57) ABSTRACT

Thermostatic expansion valve for a vehicle air-conditioning system including a housing and a power element supported by the housing. The power element includes a diaphragm, and a pressure pad disposed against the diaphragm. The pressure pad may be formed in one piece from copper, a copper alloy, or another material, which material may also be a blend, composite, mixture, or other combination, having a thermal conductivity of at least about 800 BTU-in/hr-ft$^2$-° F. (115 W/m-K), and preferably 1200 BTU-in/hr-ft$^2$-° F. (170 W/m-K), and more preferably at least about 2000 BTU-in/hr-ft$^2$-° F. (280 W/m-K), and a density of at least about 0.3 lb/in$^3$ (8 g/cm$^3$), and is connected via a stem to a valve element in the housing to control the refrigerant flow between the condensor and evaporator. The use of such material in the pressure pad reduces the susceptibility of the valve to external temperature changes and reduces the hunting of the valve.

23 Claims, 4 Drawing Sheets

U.S. PATENT DOCUMENTS 3,699,778 A 10/1972 Orth
3,738,573 A 6/1973 Eschbaugh et al.
3,742,722 A 7/1973 Leimbach
3,810,366 A 5/1974 Orth
3,979,923 A 9/1976 Jennings
4,416,416 A 11/1983 Malthy
4,468,054 A 8/1984 Orth
4,542,879 A 9/1985 Stein
4,815,698 A 3/1989 Palmer
4,819,443 A 4/1989 Watanabe et al.
4,834,337 A 5/1989 Chorkey et al.
4,852,364 A 8/1989 Seener et al.
4,979,372 A 12/1990 Tanmaka
4,984,735 A 1/1991 Glennon et al.
4,995,742 A 2/1991 Cattaneo
5,044,170 A 9/1991 Tanaka
5,060,485 A 10/1991 Watanabe et al.
5,127,237 A 7/1992 Sendo et al.
5,165,251 A 11/1992 Tsukamoto et al.
5,169,178 A 12/1992 Hunzinger
5,228,619 A 7/1993 Yano et al.
5,297,728 A 3/1994 Yano et al.
5,303,864 A 4/1994 Hirota
5,361,597 A 11/1994 Hazime et al.
5,467,611 A 11/1995 Cummings et al.
5,555,739 A 9/1996 Kujirai et al.
5,775,118 A 7/1998 Endo
5,957,376 A 9/1999 Fujimoto et al.
5,961,038 A 10/1999 Okada
5,996,899 A 12/1999 Watanabe et al.
6,223,994 B1 5/2001 Fukuda et al.
6,293,472 B1 9/2001 Yano
6,560,982 B2 5/2003 Kobayashi et al.
6,626,365 B2 9/2003 Kobayashi et al.

REFRIGERATION EXPANSION VALVE WITH THERMAL MASS POWER ELEMENT

CROSS-REFERENCE TO RELATED APPLICATIONS

The present application claims the benefit of the filing date of U.S. Provisional Application Ser. No. 60/419,876, filed Oct. 18, 2002, the disclosure of which is incorporated herein by reference.

BACKGROUND OF THE INVENTION

The present invention relates generally to thermostatic expansion valves for air-conditioning systems, and more particularly to thermostatic expansion valves for vehicle air-conditioning systems.

In a typical vehicle air-conditioning system, refrigerant is compressed by a compressor unit driven by the automobile engine. The compressed refrigerant, at high temperature and pressure, enters a condenser where heat is removed from the compressed refrigerant. The refrigerant then travels through a receiver/dryer to an expansion valve. The expansion valve throttles the refrigerant as it flows through a valve orifice, which causes the refrigerant to change phase from liquid to a saturated liquid/vapor mixture as it enters the evaporator. In the evaporator, heat is drawn from the environment to replace the latent heat of vaporization of the refrigerant, thus cooling the environmental air. The low pressure refrigerant flow from the evaporator returns to the suction side of the compressor to begin the cycle anew.

The high pressure refrigerant flow through the expansion valve must be regulated in response to the degree of superheat of the refrigerant flow between the evaporator and suction side of the compressor to maximize the performance of the air-conditioning system. The superheat is defined as the temperature difference between the actual temperature of the low pressure refrigerant flow and the temperature of evaporation of the flow. One type of device used to remotely sense the degree of superheat of the flow is a feeler bulb. The feeler bulb is positioned in contact with the pipe carrying the low pressure refrigerant. A pressure carrier extends from the feeler bulb to a valve element in the expansion valve to regulate refrigerant flow between the evaporator and the condenser.

Another, more recent device to sense the degree of flow superheat is the block-type ("bulbless") thermostatic expansion valve. Bulbless thermostatic expansion valves typically include a power element comprising a diaphragm mounted between a domed head and a support cup on the valve body. A "charge" is located within the head chamber defined by the domed head and one (upper) surface of the diaphragm. The support cup and the other (lower) surface of the diaphragm define a diaphragm chamber with the body of the expansion valve. A pressure pad is located against the lower surface of the diaphragm, and extends downwardly through the diaphragm chamber and through an opening in the valve body into the refrigerant flow path from the evaporator outlet. A valve stem is connected to the pressure pad, and extends further downwardly through a bore in the valve body to a valve element modulating a valve orifice between a first port in the valve body (to the condenser) and a second port in the valve body (to the evaporator).

A typical valve element for a thermostatic expansion valve includes a ball located in a ball retainer or ball seat which is biased by a spring against the valve orifice between the condenser port and the evaporator port. It is also known to support the ball directly against the end coil of the spring, and to use a cone-shaped element instead of a ball. In any case, the valve stem engages the ball and urges the ball away from the valve orifice in response to movement of the diaphragm. The spring is held in place by a gland or spring seat, which can be screwed into the passage leading to the outlet in the body. Adjustment of the axial location of the gland (such as by screwing the gland into or out of the valve body) adjusts the spring force on the valve ball, and hence adjusts the flow through the valve. The ball retainer and gland are typically formed from brass, and are otherwise separated from each other by the spring.

To control the refrigerant flow, the diaphragm in the power element senses the refrigerant condition exiting the evaporator and compensates the flow rate to the evaporator by opening or closing the valve orifice. In certain bulbless valves, the pressure pad is thermally conductive, and as the refrigerant from the evaporator outlet passes around the pressure pad, heat energy is transferred by conduction through the pad to the refrigerant charge in the head chamber above the diaphragm valve. A portion of the diaphragm surrounding the pressure pad is typically also exposed to and in direct contact with the refrigerant from the evaporator outlet. Refrigerant pressure from the evaporator outlet against the diaphragm along with the force of an adjustment spring on the valve element tends to close the valve, while pressure from the charge tends to open the valve. The balance of forces across the diaphragm along with the spring constant of the diaphragm determine the deflection of the diaphragm and hence the opening of the expansion valve orifice between the condenser and evaporator. The diaphragm deflects as appropriate to maintain a balance between these forces.

The pressure of the charge in the head chamber above the diaphragm valve is governed by the pressure/temperature relationship of the gas(es) in the charge. The pressure pad ideally becomes the same temperature as the refrigerant flowing through the valve, and along with the refrigerant in direct contact with the diaphragm, the temperature of the charge generally follows the temperature of the refrigerant exiting the evaporator. Fukuda, U.S. Pat. No. 6,223,994; Proctor, U.S. Pat. No. 3,691,783; Treder, U.S. Pat. No. 3,537,645; and Orth, U.S. Pat. No. 3,450,345, show and describe examples of bulbless expansion valves such as described above.

One of the issues that designers of bulbless expansion valves have had to address is the sensitivity of the valves to external conditions. For example, in vehicle engine compartments, the expansion valve can be subject to substantial thermal transients which can detrimentally affect the operating characteristics of the valve and hence impact the performance of the system. This is believed due in part to the heat energy provided by conduction from the ambient surrounding the valve through the power element to the charge in the head chamber. Heat energy from a vehicle engine can increase during engine operation, which can cause the temperature and pressure within the head chamber to increase irrespective of the damping effect of the pressure pad and the direct contact of the refrigerant with the diaphragm. In this situation, the valve can open more than desired, which can allow excess refrigerant to flow through the valve and consequently, liquid refrigerant to flow to the compressor. Liquid refrigerant flow to the compressor can be detrimental for proper compressor function, and affect the performance of the compressor and hence the over-all performance of the air-conditioning system.

Attempts have been made to closely thermally couple the charge to the refrigerant, to in effect, use the refrigerant as a heat sink. One known technique is to use a highly-conductive pressure pad, formed from e.g., aluminum, to cause the valve to be less susceptible to external conditions—and more closely follow the temperature changes in the refrigerant.

However, in so doing, the valve can become overly-sensitive to temperature changes in the refrigerant. An aluminum pressure pad, for example, almost instantaneously transfers heat energy between the refrigerant and the charge. This can also be detrimental, as the valve can then be susceptible to hunting. That is, there a lag time between a superheat transient in the low pressure refrigerant flow, and a compensating regulation in the expansion valve. The valve tends to over-compensate in both directions. As can be appreciated, this can also negatively effect the performance of the air-conditioning system.

It is believed one of the primary reasons for such sensitivity and hunting problems is because conventional wisdom is to form the pressure pad from aluminum. While aluminum is an inexpensive, easily-workable material; it does not have sufficient thermal mass to absorb thermal transients in the refrigerant and prevent (or at least reduce) the hunting of the valve.

Techniques are known which have attempted to address the hunting issue in valves with aluminum pressure pads. One technique is to add an insulator such as a plastic sleeve around the pin of the pressure pad to reduce the rate of heat transfer. This can improve the "hunting" of the valve, but it adds manufacturing complexity.

Thus, applicants believe heretofore there has been a trade-off between achieving appropriate sensitivity to the temperature of the refrigerant vapor in the valve, and smooth operation of the valve, so as to maintain a proper control of the refrigerant flow in a refrigeration system. Applicants therefore believe there is a demand in the industry for a simple thermostatic expansion valve which overcomes the above issues, that is, for a valve which has a reduced sensitivity to external temperature transients, particularly temperature fluctuations caused by engine heat in an engine compartment, and which is more appropriately responsive to temperature changes in the refrigerant from the evaporator.

SUMMARY OF THE INVENTION

A novel and unique thermostatic expansion valve is hereby provided which has a reduced sensitivity to external temperature transients, particularly temperature fluctuations caused by engine heat in an engine compartment, and which is appropriately responsive to temperature changes in the refrigerant from the evaporator.

According to the present invention, the thermostatic expansion valve includes a pressure pad which is formed from a material which is sufficiently conductive to prevent the valve from being overly-sensitive to external conditions; but which also has sufficient thermal mass to reduce the hunting of the valve. The pressure pad includes a solid cylindrical body, an enlarged head at one end, and an elongated pin extending axially downward from another end, all of which are preferably formed unitary, in one-piece, from copper, a copper alloy, or another material, which material may also be a blend, composite, mixture, or other combination, having a thermal conductivity of at least about 800 BTU-in/hr-ft$^2$-° F. (115 W/m-K), and preferably at least about 1200 BTU-in/hr-ft$^2$-° F. (170 W/m-K), and more preferably at least about 2000 BTU-in/hr-ft$^2$-° F. (280 W/m-K), and a density of at least about 0.3 lb/in$^3$ (8 g/cm$^3$). Advantageously, the pressure pad of the present invention is relatively simple to manufacture, and has reasonable cost.

The present invention thereby provides a novel and unique thermostatic expansion valve which it is believed overcomes many of the drawbacks of the prior devices. The valve has a reduced sensitivity to external temperature transients, and is more appropriately responsive to temperature changes in the refrigerant from the evaporator.

Further features of the present invention will become apparent to those skilled in the art upon reviewing the following specification and attached drawings.

DETAILED DESCRIPTION OF THE PREFERRED EMBODIMENT

Figure 1:
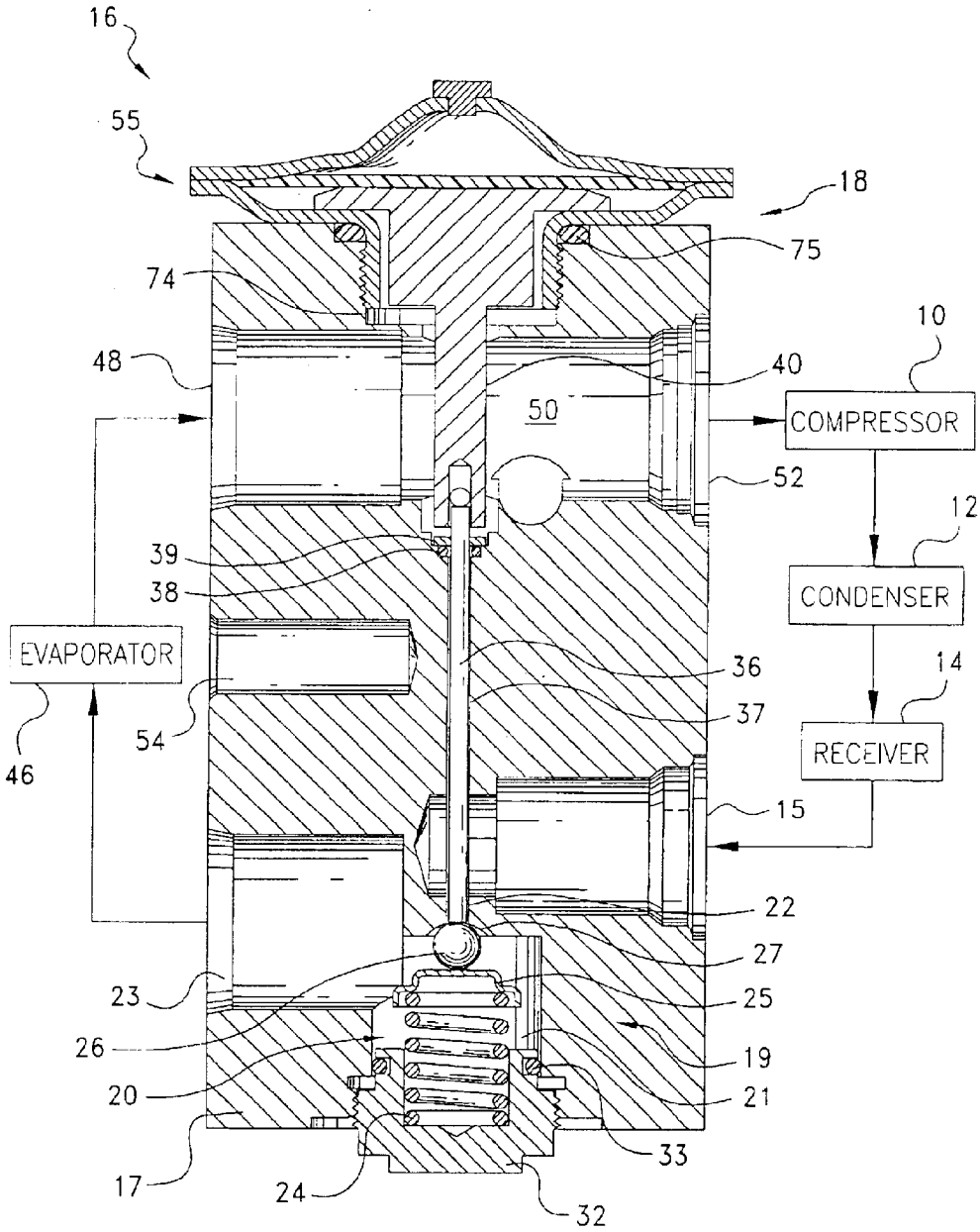
FIG. 1 is a cross-sectional side view of an expansion valve constructed according to the principles of the present invention.

Referring to the drawings, and initially to FIG. 1, refrigerant in an air-conditioning system flows from compressor 10 to condensor 12 and from the condensor to either a receiver/dryer 14 or directly into inlet port 15 of a thermostatic expansion valve, indicated generally at 16. The expansion valve includes a body 17 having a control sensing section, indicated at 18, and a metering section, indicated at 19. A ball-type valve assembly, indicated generally at 20, is disposed in a cavity 21 of the metering section and controls the flow through a metering passage 22 defined between inlet port 15 (condenser outlet) and outlet port 23 (evaporator inlet). Valve assembly 20 includes a spring 24 which biases a holder or cup 25 supporting a ball valve 26 against a valve seat 27 to meter refrigerant flow through passage 22. Spring 24 is supported within a spring seat 32, which is threadably connected to body 17, and sealed thereto by O-ring seal 33. Valve assembly 20 may be adjusted by turning spring seat 32 inwardly or outwardly in body 17.

The ball valve is actuated by push pin or stem 36 extending axially through the housing in close sliding relationship with an internal bore 37. An O-ring elastomeric seal 38 surrounds and fluidly seals stem 36 within bore 37, and is held in place by a ring 39. Stem 36 is, in turn, connected to a pressure pad 40 (see also, FIGS. 2 and 3), which is connected to diaphragm 42. Flow from the valve outlet port 23 in the metering section flows to evaporator 46 and then passes into inlet port 48 of the control sensing section of the body. Flow then passes through return passage 50, which fluidly interconnects inlet port 48 with outlet port 52, and then back through an evaporator outlet control valve (not shown), or directly into compressor 10.

The expansion valve described above is preferably a block-type valve formed from an appropriate material such as metal (e.g., aluminum alloy). The valve body has a rectangular configuration typically with the inlet and outlet ports 15, 23 of the metering section 19 on two (typically opposite) side surfaces of the body 17 and located toward one end of the body; while the inlet and outlet ports 48, 52 of the control sensing section 18 are on the same side surfaces as inlet and outlet ports 23, 15 respectively, but are located toward the other end of body 17. Mounting holes 54 are also provided in the body for mounting the valve to appropriate fixtures in the system. It is noted that return passage 50 in control sensing section 18 typically extends laterally through body 17, or in other words, when expansion valve 16 is used in the vertical orientation illustrated in FIG. 1, passage 50 extends essentially horizontally through the valve.

Figure 2:
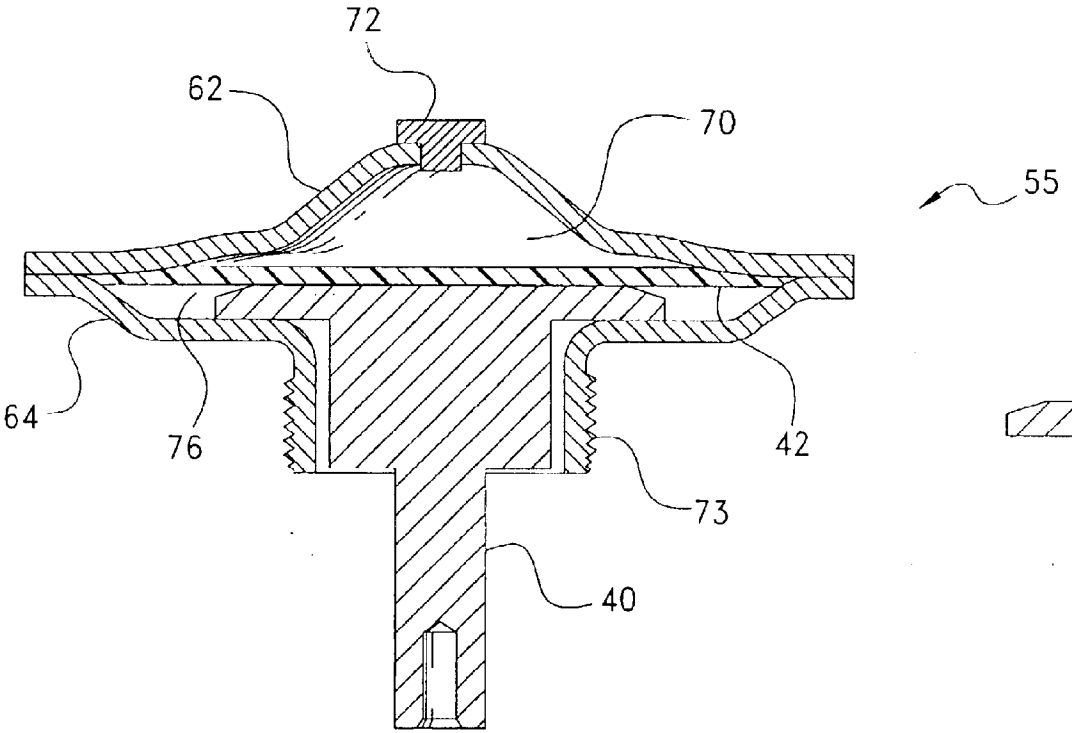
FIG. 2 is a cross-sectional side view of the power element for the expansion valve.

A power element, indicated generally at 55, is provided integral with, and preferably mounted to one (upper) end surface of body 17. As illustrated in FIG. 2, power element 55 includes annular diaphragm 42, which is mounted between an annular domed head or upper housing portion 62, and an annular support cup or lower housing portion 64. Diaphragm 42 is preferably formed from a thermally-conductive material, such as metal (e.g., stainless steel), and is sealed around its periphery to domed head 62 and support cup 64, such as by welding or brazing. A head chamber 70 is defined between domed head 62 and one (upper) surface of diaphragm 42. Head chamber 70 is charged with a temperature-responsive charge through an aperture or capillary tube (not shown), and is then sealed off as with plug 72, or by other appropriate means.

Figure 3:
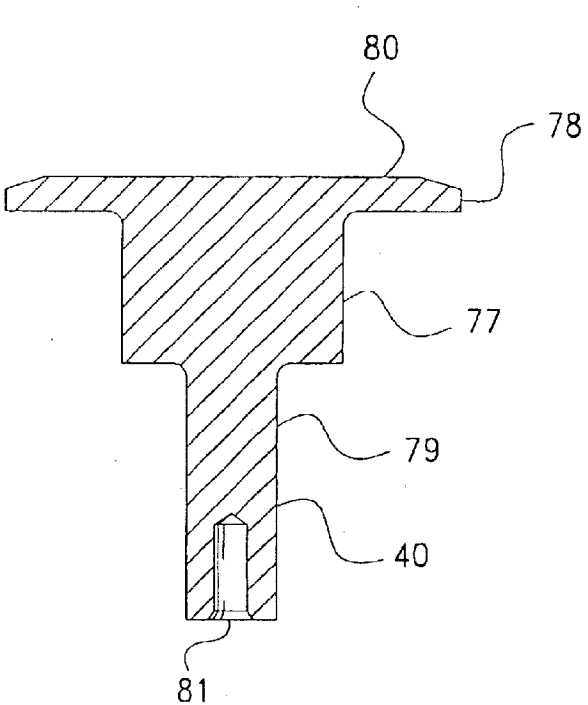
FIG. 3 is a cross-sectional side view of the pressure pad for the expansion valve.

On the other side of the diaphragm, support cup 64 has an annular collar 73 which is threaded into axial control passage 74 (FIG. 1) formed in the upper end of valve body 17 to mount the power element to the valve body. Axial control passage 74 is fluidly open at its inner end to lateral passage 50 extending between inlet port 48 and outlet port 52 in the control sensing section. An O-ring seal 75 surrounds and fluidly-seals the exterior of support cup 64 to body 17. The other (lower) surface of diaphragm 42 and support cup 64 define a diaphragm chamber 76 (FIG. 3). Diaphragm chamber 76 is in fluid communication with axial control passage 74.

According to the present invention, to maintain appropriate sensitivity to the temperature of the refrigerant flow through the valve, and to reduce the susceptibility of the valve to hunting, the pressure pad 40 is preferably formed substantially entirely from a relatively dense and highly thermally-conductive material such as copper, a copper alloy, or another material, which material may also be a blend, composite, mixture, or other combination, having a thermal conductivity of at least about 800 BTU-in/hr-ft$^2$-° F. (115 W/m-K), and preferably at least about 1200 BTU-in/hr-ft$^2$-° F. (170 W/m-K), and more preferably at least about 2000 BTU-in/hr-ft$^2$-° F. (280 W/m-K), and a density of at least about 0.3 lb/in$^3$ (8 g/cm$^3$). Forming the pressure pad from such a material has been found to have particularly advantageous properties when used in thermostatic expansion valves. These properties include i) good thermal conductivity sufficient to closely couple the temperature of the refrigerant in the valve with the charge temperature to achieve good sensitivity of the valve to the refrigerant; and ii) a sufficient thermal mass such that the power element is not as susceptible to hunting, as is found with pressure pads formed from materials such as, e.g., aluminum or a conventional brass or bronze, which either may be highly conductive but not relatively dense, or relatively dense but not highly conductive. A material such a copper or a copper alloy, particularly, is easily workable, and has reasonable cost.

As shown in FIG. 2, the pressure pad 40 has a solid cylindrical body 77, an annular, enlarged circular head 78 at one (upper) end of body 77, and an elongated cylindrical pin or rod 79 projecting axially away (downwardly) from the other end of body 77. Body 77, head 78 and pin 79 are preferably machined, cast, stamped, molded, or otherwise formed together, unitarily (in one piece), but alternatively may be formed as separated components which may be bonded or otherwise joined together, such as by brazing, welding, adhesive bonding, thermal or solvent fusion bonding, or mechanically. The body 77 of the pressure pad 40 is preferably disposed in diaphragm chamber 76. The upper surface 80 of head 78 in surface-to-surface engaging contact with the lower surface of diaphragm 42, and as such, is directly and closely thermally coupled to the diaphragm. The radial dimension of head 78 with respect to diaphragm 42 can vary, and it is preferred that at least a small portion of the diaphragm surrounding the periphery of base 78 is also directly exposed to fluid flow in chamber 76.

Pin 79 projects downwardly from body 77, through axial control passage 74, and through return passage 50. Pin 79 includes a blind end bore 81 formed inwardly from the distal end of the pin for receiving stem 36 (FIG. 1) of valve assembly 20 such that the pin (and hence the pressure pad) is operatively connected to the valve. Stem 36 can be fixedly retained within bore 81 in any conventional manner, such as by a press-fit or threads.

Again, it is preferred that the entire pressure pad be formed, either as unitarily constructed or as assembled from separate components, from a material having good thermal conductivity, but as also being relatively dense so as to not be overly susceptible to temperature gradients. That is, such a material provides smooth operation of the valve because of the relatively high thermal mass of the pressure pad so formed.

In addition to copper and copper alloys, such as brass or bronze, other suitable materials include other metals and alloys such as aluminum and stainless steel, as well as non-metals such as ceramics, herein broadly used to included nitrides, carbides, and borides in addition to oxides, carbon and allotropes thereof such as graphite and diamond, and plastics and other polymeric materials, which may be either thermoplastic or thermoset. Combinations of two or more of these materials, such as two or more different coppers or copper alloys, or two or more different other metals or alloys, ceramics, carbon or carbon allotropes, or polymeric materials, or plastics also may be suitable, as well as combinations of one or more of these materials and one or more of another of these materials, such as one or more metals and one or more non-metals, further are to be considered within the scope of the invention herein involved. These combinations may be mixtures, alloys, blends, co-polymers, or composites.

In the case of a unitary construction of the pressure pad, the pad may be substantially entirely formed of the above-mentioned materials, either generally homogenously, or as laminate or other construction such as a coating provided over a core. In the case of the pad being formed as an assembly of separate components, each of these components may be formed of the same or different materials.

In the case of a single material or a combination of materials, the materials themselves may be selected, formulated or combined so as to exhibit in bulk a thermal conductivity of at least about 800 BTU-in/hr-ft$^2$-° F. (115 W/m-K), and preferably at least about 1200 BTU-in/hr-ft$^2$-° F. (170 W/m-K), and more preferably at least about 2000

BTU-in/hr-ft$^2$-° F. (280 W/m-K), and a density of at least about 0.3 lb/in$^3$ (8 g/cm$^3$). In this regard, the attendant pad so formed itself similarly may exhibit an overall thermal conductivity of at least about 800 BTU-in/hr-ft$^2$-° F. (115 W/m-K), and preferably at least about 1200 BTU-in/hr-ft$^2$-° F. (170 W/m-K), and more preferably at least about 2000 BTU-in/hr-ft$^2$-° F. (280 W/m-K), and a density of at least about 0.3 lb/in$^3$ (8 g/cm$^3$). In the case of an assembly, the materials of each of the individual components may themselves be selected, formulated, or combined so as to each exhibit in bulk a thermal conductivity of at least about 800 BTU-in/hr-ft$^2$-° F. (115 W/m-K), and preferably at least about 1200 BTU-in/hr-ft$^2$-° F. (170 W/m-K), and more preferably at least about 2000 BTU-in/hr-ft$^2$-° F. (280 W/m-K), and a density of at least about 0.3 lb/in$^3$ (8 g/cm$^3$). Otherwise, the materials may be selected, formulated, or combined such that the pad assembly itself exhibits an overall thermal conductivity of at least about 800 BTU-in/hr-ft$^2$-° F. (115 W/m-K), and preferably at least about 1200 BTU-in/hr-ft$^2$-° F. (170 W/m-K), and more preferably at least about 2000 BTU-in/hr-ft$^2$-° F. (280 W/m-K), and a density of at least about 0.3 lb/in$^3$ (8 g/cm$^3$). For reasons of economy and ease of manufacture, a copper, or an alloy or other material that includes copper, may be considered preferred.

A portion of the refrigerant entering inlet port 48 from the evaporator outlet normally diverges from the flow path through passage 50 and flows through passage 74 into diaphragm chamber 76. Refrigerant in chamber 76 comes into direct contact with the body 77 and lower surface of the head 78, as well as the lower surface of diaphragm 42 around the periphery of head 78. The refrigerant then exits chamber 76 and passage 74 and rejoins the flow through passage 50 to pass through outlet port 52 to the compressor inlet. Refrigerant pressure from the evaporator outlet through port 48 and against the lower surface of head 78 and diaphragm 42, along with the force of the adjustment spring 24 on the valve element tends to force the ball valve against seat 27; while pressure from the charge in chamber 70, as influenced by the thermal transfer through the pressure pad 40 and the exposed portion of the diaphragm 42, tends to open the valve. The balance of forces across the diaphragm along with the spring constant of the diaphragm determine the deflection of the diaphragm and hence the opening of the expansion valve orifice between the condenser and evaporator. The diaphragm deflects as appropriate to maintain a balance between these forces.

Again, a copper, copper alloy, or other pressure pad formed in accordance with the precepts of the present invention has good thermal conductivity so that the charge in head chamber 70 is closely thermally coupled to the refrigerant, and thereby follows the temperature of the refrigerant—rather than ambient temperature. The thermal mass of such pressure pad dampens or otherwise stabilizes the effects of temperature transients in the refrigerant, and in effect, impose a time lag or other delay in the transfer of the temperature changes to the charge. In all, the charge in the head chamber is less susceptible to external temperature influences, and more closely and smoothly follows the temperature of refrigerant exiting the evaporator.

The Examples to follow, wherein all percentages and proportions are by weight unless otherwise expressly indicated, are illustrative of the practicing of the invention herein involved, but should not be construed in any limiting sense.

EXAMPLES

Example 1

Thermal mass power elements having pressure pads configured generally as is shown in FIGS. 2–3 were constructed of aluminum (Type 6061), free cutting brass (Type C360000), and copper tellurium (Type C14500). These power elements were essentially identical except for the material of construction of the pressure pads. The properties of these materials of construction for the pads are given in Table 1 below.

TABLE 1

| Material | Density lb/in$^3$ (g/cm$^3$) | Thermal Conductivity BTU-in/hr-ft$^2$-° F. (W/m-K) |
|---|---|---|
| aluminum | 0.0975 (2.7) | 1250 (280) |
| brass | 0.307 (8.5) | 798 (115) |
| copper | 0.323 (8.9) | 2460 (350) |

The copper material has a density and thermally conductive falling within the range which is comprehended by the present invention. Thus, the power element which includes the copper pressure pad is to be considered representative of the present invention.

These power elements were installed within a thermostatic expansion valve configured. The valve, in turn, was installed within a typical vehicle-type refrigeration system (R-134a refrigerant) as placed within an insulated enclosure having a heat source which was external to the system. The system was operated until it reached steady-state flow, whereupon the ambient temperature in the enclosure surrounding the valve was increased to about 250° F. (120° C.). As the ambient temperature increased the temperature of the power element, the attendant higher pressure opens the valve wider and causes more refrigerant to flow into the evaporator. The increase flow eventually cools the element and lowers the pressure, resulting in a cyclic response over time.

Figure 4:
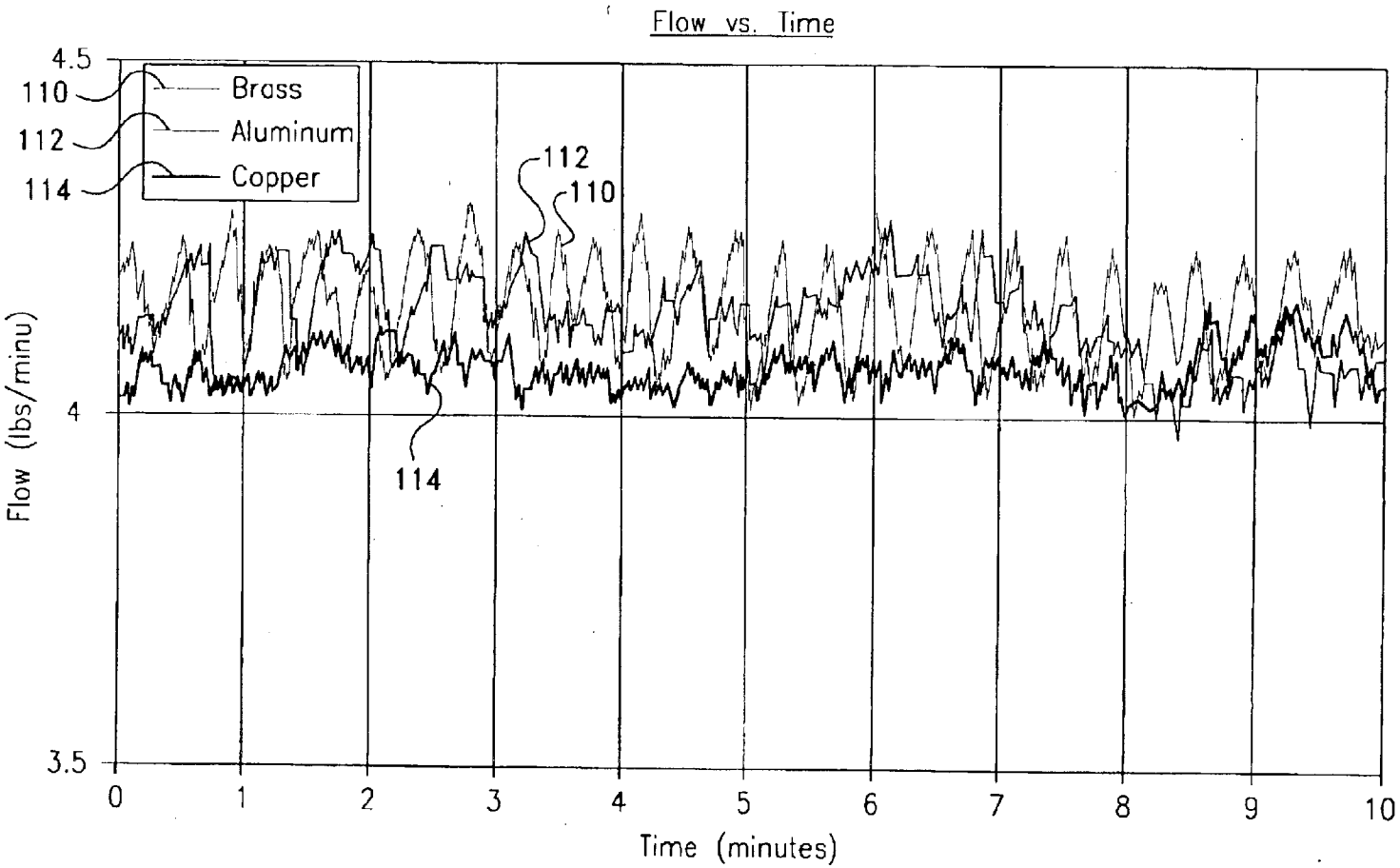
FIG. 4 is a plot of flow rate versus time for a representative thermostatic expansion valve including a thermal mass power element formed in accordance with the present invention, and as compared to power elements representative of the prior art.

The measured responses for the different pressure pads are graphically portrayed in FIG. 4 as a comparative plot of flow rate versus time. The individual traces for the brass, aluminum, and copper pads are designated in FIG. 4 at 110, 112, and 114, respectively, for ease of reference.

As may be seen in FIG. 4, the amplitude of the cycles is less for the copper (114) that has both a high density and thermal conductivity. The aluminum (112), in contrast, has a high thermal conductivity but a low density so it reacts faster to changes, which also makes it very susceptible to ambient sensitivity. The brass (110) has a lower thermal conductivity than aluminum so it responds slower, but it has higher density so in combination it functions very similar to the aluminum.

As for the copper pad, without being bound by theory, it is believed that the high thermal conductivity allows heat that is transferred from the ambient to be conducted away the refrigerant flowing through the valve. The high density, and therefore high thermal mass of the pad, prevents the power element form undergoing rapid changes in temperature whether externally or internally, i.e., within the system, introduced. However, the high thermal conductive allow the valve to respond appropriately to system demands, but without being overly sensitive to system changes.

Example 2

The performance of representative commercial valves was compared to that of a valve having a copper pad in accordance with the present invention. The valves were tested essentially as described in Example 1, but with the flow rates for the R-134a refrigerant being normalized, by subtracting the observed average flow rate, to allow for a direct comparison of the responses. These responses are portrayed graphically in FIG. 5 as a plot of normalized flow rates versus time. The valves tested are described in Table 2 which follows, with the trace numbers in FIG. 5 also being shown.

TABLE 2

| Valve | Trace | Description |
|---|---|---|
| Hollow[1] | 120 | Hollow pin element (U.S. Pat. No. 5,269,459) |
| Brass #1 | 122 | Solid brass (C36000) pressure pad |
| Phosphor Bronze | 124 | Solid P-bronze (C54400[1]) thermal mass |
| Aluminum #1 | 126 | pressure pad Solid Al (6061) pressure pad |
| Brass #2 | 128 | Solid brass (C3600) thermal mass pressure pad (larger volume than Brass #1) |
| Aluminum #2 | 130 | Solid Al (6061) pressure pad larger in volume than Aluminum #1) |
| Copper | 132 | Solid copper (C14500) thermal mass pressure pad |

[1]Density: 0.321 lb/in$^3$ (8.9 g/cm$^3$); Thermal Cond.: 604 BTU-in/hr-ft$^2$-° F. (87 W/m-K)

Figure 5:
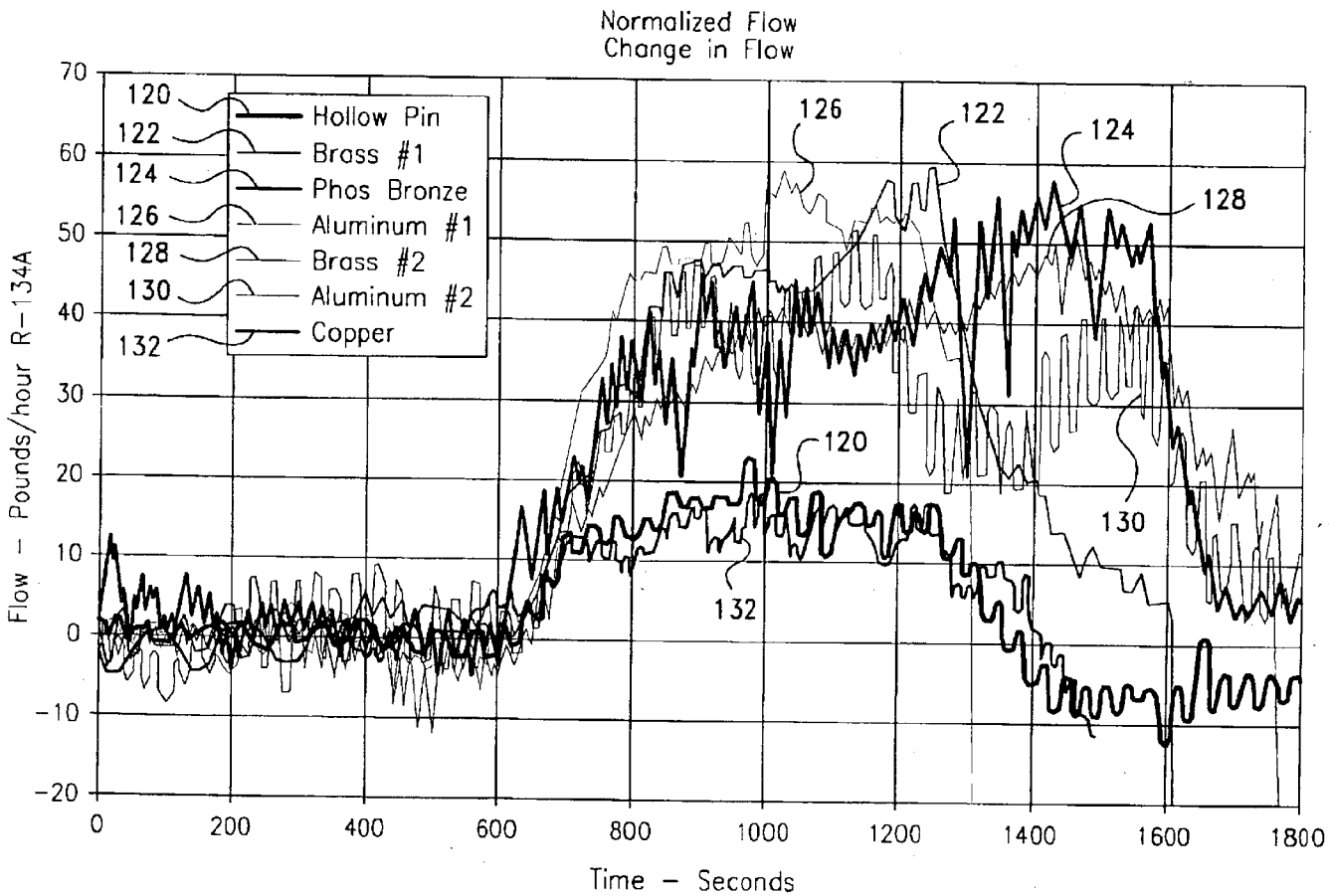
FIG. 5 is a plot of normalized flow rate versus time for a thermostatic expansion valve including a thermal mass power element formed in accordance with the present invention, and as compared to thermostatic expansion valves representative of the prior art.

With reference to FIG. 5, the Hollow Pin valve (120) appears to be the most stable. In this regard, it is speculated that the refrigerant in the power element migrates to the its coldest spot, namely, the bottom of the pin that is in the refrigerant flow stream. This allows the valve to maintain control based on the temperature of the refrigerant flow rather than the ambient. However, the hollow pin design is relatively complicated to and expensive to manufacture.

The Aluminum #1 valve (126,) appear to show the most deviation from the average initial flow set point (shown as "0" on the flow rate axis). The pressure pad in this design is a relatively small aluminum part that has very little mass and conducts heat well.

The Brass #1 valve (122) has a brass pad with more volume than Aluminum #1 valve, but less than the brass thermal mass pressure pad valve (Brass #2) (128).

The Aluminum #2 (130), copper (132), Brass #2 (128) and phosphor bronze (124) valves have thermal mass pressure pads with more volume that the other valves. The aluminum responds quickly due to its high thermal conductivity. The phosphor bronze pad absorbs the heat but cannot transfer it well to the refrigerant flow stream, thus causing the more deviation as compared to the other thermal mass valves.

The brass pad has a marginally higher thermal conductivity so it is able to transfer heat better than the phosphor bronze pad, but not as well as the aluminum and copper pads. The copper pad, again in accordance with the present invention, has the highest thermal conductivity, and so it can best transfer heat from the ambient to the refrigerant flow stream and thus best control the flow. The higher density of the copper pad means that while it is conducting heat, the larger mass makes it more thermally stable, and thus does not respond near instantaneously to temperature changes as does the aluminum pad, thereby resulting in a more stable operation. Overall, the copper pad, as representative of the invention herein involved, performs comparable to the hollow pin design, but is less expensive and easier to manufacture.

Thus, as described above, the present invention provides a new and unique thermostatic expansion valve which minimizes the susceptibility of the valve to external temperature transients, i.e., is resistant to ambient temperature changes, and which is appropriately responsive to temperature variants in the refrigerant flow, i.e., reduces "hunting" or other oscillatory effects and otherwise stable in operation. The expansion valve of the present invention accomplishes this result without complex hardware and in a simple and cost-effective manner without difficult or time-consuming manufacturing or assembly steps.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims. All references including any priority documents cited herein are expressly incorporated by reference.

What is claimed is:

1. A thermostatic expansion valve, comprising:

a valve body having a metering passage fluidly connecting a condenser outlet port and an evaporator inlet port, and a return passage fluidly connecting an evaporator outlet port and a compressor inlet port, said valve body also including a control passage fluidly-connected to said return passage;

a power element mounted to said valve body, said power element including diaphragm housing portions supporting a diaphragm, one housing portion together with one surface of the diaphragm defining a head chamber for containing a fluid charge, and another housing portion together with another surface of the diaphragm cooperating with the body and defining a diaphragm chamber, the control passage fluidly connecting the diaphragm chamber with the return passage;

a valve in a valve bore extending between the metering and return passages, said valve having a valve element disposed in said metering passage moveable from a first position preventing fluid flow through the metering passage to a second position allowing fluid flow through the metering passage; and a pressure pad having a thermal conductivity of at least about 800 BTU-in/hr-ft$^2$-° F. (115 W/m-K), and a density of at least about 0.3 lb/in$^3$ (8 g/cm$^3$), and disposed at least partially in said return passage, said pressure pad including i) a body, ii) an enlarged head at one end of the pressure pad body disposed against the diaphragm and moveable in conjunction therewith, and iii) a pin integral with and extending away from another end of the pressure pad body, and operatively connected to said valve.

2. The valve as in claim 1, wherein the pin, pressure pad body and head of the pressure pad are unitary.

3. The valve as in claim 2, wherein said pressure pad body is a solid cylinder.

4. The valve as in claim 1, wherein one or more of said pressure pad body, pin, and head is formed substantially entirely of a material having a thermal conductivity of at least about 800 BTU-in/hr-ft$^2$-° F. (115 W/m-K), and a density of at least about 0.3 lb/in$^3$ (8 g/cm$^3$).

5. The valve as in claim 4 wherein said material comprises one or more metals, one or more metal alloys, one or more ceramics, carbon, one or more carbon allotropes, one or more polymeric materials, or a combination thereof.

6. The valve as in claim 4 wherein said material comprises copper.

7. The valve as in claim 2, wherein said pressure pad is formed substantially entirely of a material having a thermal conductivity of at least about 800 BTU-in/hr-ft$^2$-° F. (115 W/m-K), and a density of at least about 0.3 lb/in$^3$ (8 g/cm$^3$).

8. The valve as in claim 7 wherein said material comprises one or more metals, one or more metal alloys, one or more ceramics, carbon, one or more carbon allotropes, one or more polymeric materials, or a combination thereof.

9. The valve as in claim 7 wherein said material comprises copper.

10. The valve as in claim 1 wherein said pressure pad has a thermal conductivity of at least about 2000 BTU-in/hr-ft$^2$-° F. (280 W/m-K).

11. The valve as in claim 1 wherein said pressure pad has a thermal conductivity of at least about 1200 BTU-in/hr-ft$^2$-° F. (170 W/m-K).

12. The valve as in claim 1, wherein one or more of said pressure pad body, pin, and head is formed substantially entirely of a material having a thermal conductivity of at least about 2000 BTU-in/hr-ft$^2$-° F. (280 W/m-K), and a density of at least about 0.3 lb/in$^3$ (8 g/cm$^3$).

13. The valve as in claim 1, wherein one or more of said pressure pad body, pin, and head is formed substantially entirely of a material having a thermal conductivity of at least about 1200 BTU-in/hr-ft$^2$-° F. (170 W/m-K), and a density of at least about 0.3 lb/in$^3$ (8 g/cm$^3$).

14. The valve as in claim 2, wherein said pressure pad is formed substantially entirely of a material having a thermal conductivity of at least about 2000 BTU-in/hr-ft$^2$-° F. (280 W/m-K), and a density of at least about 0.3 lb/in$^3$ (8 g/cm$^3$).

15. The valve as in claim 2, wherein said pressure pad is formed substantially entirely of a material having a thermal conductivity of at least about 1200 BTU-in/hr-ft$^2$-° F. (170 W/m-K), and a density of at least about 0.3 lb/in$^3$ (8 g/cm$^3$).

16. A thermostatic expansion valve, comprising:

a valve body having a pair of side surfaces and upper and lower end surfaces, said valve body including a metering passage fluidly connecting a condenser outlet port on one side surface with an evaporator inlet port on the other side surface, and a return passage fluidly connecting an evaporator outlet port on the one side surface with a compressor inlet port on the other side surface, said valve body also including a control passage fluidly connected to said return passage;

a power element mounted to said one end surface of said housing, said power element including a diaphragm supported by an outer domed head and an inner support cup, said domed head and an outer surface of the diaphragm defining a charge chamber for containing a fluid charge, and said support cup and an inner surface of the diaphragm cooperating with the valve body to enclose the diaphragm chamber, said control passage fluidly connecting the diaphragm chamber with the return passage, a valve having a valve stem disposed in a valve bore extending between the metering and return passages, said valve including a valve element at one end of the valve stem in said metering passage moveable from a first position preventing fluid flow through the metering passage to a second position allowing fluid flow through the metering passage; and a unitary pressure pad at another end of the valve stem in thermally-conductive contact with the inner surface of the diaphragm and in thermal contact with fluid flowing through said return passage, said pressure pad having a thermal conductivity of at least about 800 BTU-in/hr-ft$^2$-° F. (115 W/m-K), and a density of at least about 0.3 lb/in$^3$ (8 g/cm$^3$), and including i) a solid cylindrical body disposed in the diaphragm chamber, ii) an enlarged circular head at one end of the pressure pad body disposed in surface-to-surface contact with the diaphragm, and iii) a cylindrical pin integral with and extending axially away from another end of the pressure pad body, into said return passage and operatively connected to said valve.

17. The valve as in claim 16, wherein said pressure pad is formed substantially entirely of a material having a thermal conductivity of at least about 800 BTU-in/hr-ft$^2$-° F. (115 W/m-K), and a density of at least about 0.3 lb/in$^3$ (8 g/cm$^3$).

18. The valve as in claim 17 wherein said material comprises one or more metals, one or more metal alloys, one or more ceramics, one or more carbon allotropes, one or more polymeric materials, or a combination thereof.

19. The valve as in claim 17 wherein said material comprises copper.

20. The valve as in claim 16 wherein said pressure pad has a thermal conductivity of at least about 2000 BTU-in/hr-ft$^2$-° F. (280 W/m-K).

21. The valve as in claim 16 wherein said pressure pad has a thermal conductivity of at least about 1200 BTU-in/hr-ft$^2$-° F. (170 W/m-K).

22. The valve as in claim 16, wherein said pressure pad is formed substantially entirely of a material having a thermal conductivity of at least about 2000 BTU-in/hr-ft$^2$-° F. (280 W/m-K), and a density of at least about 0.3 lb/in$^3$ (8 g/cm$^3$).

23. The valve as in claim 16, wherein said pressure pad is formed substantially entirely of a material having a thermal conductivity of at least about 1200 BTU-in/hr-ft$^2$-° F. (170 W/m-K), and a density of at least about 0.3 lb/in$^3$ (8 g/cm$^3$).

* * * * *